US007585440B2

(12) United States Patent
Marlow

(10) Patent No.: US 7,585,440 B2
(45) Date of Patent: Sep. 8, 2009

(54) METHODS FOR THE MANUFACTURE OF MIXED POLYAMIDE YARNS

(75) Inventor: Stephen Walter Marlow, Cheltenham (GB)

(73) Assignee: Invista North America S.a r. l., Wilmington, DE (US)

( * ) Notice: Subject to any disclaimer, the term of this patent is extended or adjusted under 35 U.S.C. 154(b) by 0 days.

(21) Appl. No.: 10/506,348

(22) PCT Filed: Mar. 1, 2002

(86) PCT No.: PCT/US02/07864

§ 371 (c)(1),
(2), (4) Date: May 11, 2005

(87) PCT Pub. No.: WO03/074769

PCT Pub. Date: Sep. 12, 2003

(65) Prior Publication Data

US 2005/0221082 A1 Oct. 6, 2005

(51) Int. Cl.

| | |
|---|---|
| ***D01D 5/08*** | (2006.01) |
| ***D01F 1/10*** | (2006.01) |
| ***D01F 6/60*** | (2006.01) |
| ***D02G 3/02*** | (2006.01) |

(52) U.S. Cl. ..... 264/103; 28/271; 264/177.13; 264/211

(58) Field of Classification Search ..... 264/103, 264/177.13, 211; 28/220, 247, 271; 57/284
See application file for complete search history.

(56) References Cited

U.S. PATENT DOCUMENTS

| | | | | |
|---|---|---|---|---|
| 3,457,341 | A * | 7/1969 | Duncan et al. | 264/177.13 |
| 3,481,133 | A * | 12/1969 | Knospe | 57/245 |
| 3,682,866 | A | 8/1972 | Garforth | |
| 3,707,344 | A | 12/1972 | Becht et al. | |
| 3,939,636 | A * | 2/1976 | Nakayama et al. | 57/245 |
| 4,075,378 | A | 2/1978 | Anton et al. | |
| 5,439,626 | A * | 8/1995 | Bennett et al. | 264/103 |
| 5,804,115 | A * | 9/1998 | Burton et al. | 264/103 |
| 6,119,320 | A | 9/2000 | Weiss | |
| 7,060,149 | B2 * | 6/2006 | Ortega et al. | 156/167 |

FOREIGN PATENT DOCUMENTS

| | | |
|---|---|---|
| EP | 81302553.3 | 12/1981 |
| EP | 0 601 372 A1 | 6/1994 |

(Continued)

OTHER PUBLICATIONS

ASTM D789—94 Standard Test Methods for Determination of Relative Viscosity, Melting Point, and Moisture Content of Polyamide (PA).

(Continued)

*Primary Examiner*—Leo B Tentoni
(74) *Attorney, Agent, or Firm*—Christina W. Geerlof

(57) ABSTRACT

The invention provides a method of making a polyamide mixed yarn comprising: simultaneously spinning a first group of filaments of a first polyamide and a second group of filaments of a second polyamide different from the first polyamide; combining the first and second groups of filaments through an air interlacing jet; and winding up the interlaced filaments. The invention also provides mixed yarns obtainable by the method of the invention, and fabrics and garments containing the yarns.

14 Claims, 1 Drawing Sheet

FOREIGN PATENT DOCUMENTS

Figure 1:
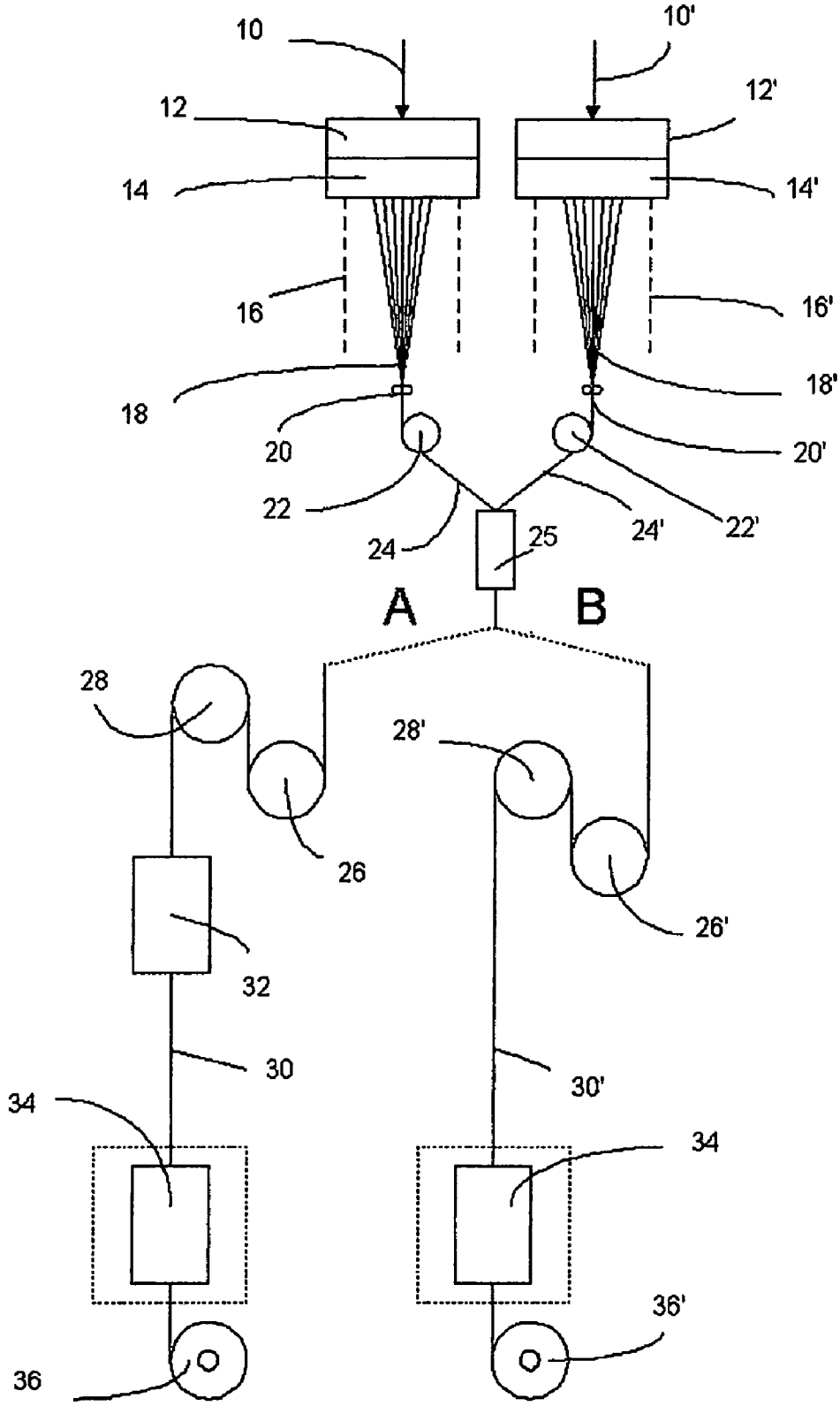

| | | |
|---|---|---|
| JP | 51143726 | 12/1976 |
| JP | 53058024 | 5/1978 |
| JP | 03180529 | 8/1991 |
| JP | 04024240 | 1/1992 |
| JP | 07189058 | 7/1995 |
| JP | 07155782 | 7/1997 |

OTHER PUBLICATIONS

ASTM D4724-87 (Reapproved 1992)—Standard Test Methods for Degree of Filament Yarn Entanglement by Needle Insertion Methods.

International Search Report PCT/US02/07864 (RD8145WO) (including cited refs.).

BISFA, The International Bureau for the Standardisation of Man-Made Fibers, "Testing Methods for Polyamide Filament Yarns." 2004 Edition.

Franz Fourne, Synthetic Fibers, Machines and Equipment, Manufacture, Properties, Handbok for Plant Engineering, Machine Design, and Operation, Hanswer Publishers, Munich, (1999).

Hans J. Koslowski, Dictionary of Man-Made Fibers, Terms Figures Trademarks, 1st Edition 1998, International Business Press Publishers.

* cited by examiner

METHODS FOR THE MANUFACTURE OF MIXED POLYAMIDE YARNS

The present invention relates to methods for the manufacture of mixed polyamide yarns for apparel textile end-uses, and to mixed yarns, textiles and garments obtainable thereby.

It is desirable to provide textile materials, especially for apparel end-uses, that comprise filaments of more than one kind of polymer. In particular, if the textile contains a plurality of different filaments having different dye affinities, then attractive visual effects can be achieved on dyeing the textile.

It is known to provide such mixed textile materials by weaving the textile with more than one kind of yarn. It is also known to provide yarns of bicomponent filaments, for example filaments having a sheath of a first polymer and a core of a second polymer. Finally, it is known to provide mixed-filament yarns by intermingling multifilament yarns spun from different materials on a texturizing machine. However, this method is not entirely satisfactory and is limited to the production of texturised mixed yarns.

Accordingly, it would be desirable to develop new mixed textile yarns, in particular polyamide yarns, for apparel applications that could be manufactured quickly and cheaply.

The vast majority of nylon (polyamide) fabrics are dyed with so-called anionic dyes that have a special affinity for the amine end groups of the yarn. Typically, anionic dyeable polyamides contain at least about 30, more typically about 40 to 60, and up to about 80 amine end group equivalents (AEG) per $10^6$ grams of polymer. Such dyes include acid dyes, pre-metallised dyes, reactive dyes and so on.

It is also known that nylon yarns, which are normally strongly dyed by anionic dyestuffs, can be rendered resistant to such dyestuffs by modifying the polymer chemistry. The agents used to modify the polyamide include bifunctional carboxylic acids, and especially sulphonated organic bifunctional acids and their esters. See for example U.S. Pat. No. 4,075,378; assigned to E. I. du Pont de Nemours and Company). Such yarns are referred to as cationic-dyeable yarns, or conveniently as cat-dye yarns, and sometimes as base-dye yarns. These yarns normally contain less than about 40 and more typically 15 amine end group equivalents per $10^6$ grams of polymer. Typically, cationic dyeable polyamides contain at least about 50 and more preferably about 70 to 150 aromatic sulphonate group equivalents per $10^6$ grams of polymer. Cationic-dye yarns are known in the manufacture of carpets, where it is possible to combine them with standard anioniod-yeable yarns to produce a two-colour heather or marl effect.

The use of cationic dyeable yarns for apparel end uses is much rarer, though not unknown. Thus there have been various commercial cat-dye yarns over the years, e.g. U.S. Pat. No. 3,682,866; assigned to Imperial Chemical Inds. PLC and U.S. Pat. No. 3,707,344; assigned to BASF. The common feature of these yarns is that they were made by fairly slow-speed spinning through a conventional two-stage route. It is known that the cationic-dyeable nylon polymers spin less well, and with higher interruption rates, than standard anionic dyeable nylon, even in the production of carpet yarns. The lighter decitex yarns used for apparel textiles, the much finer filaments, and the very large strain rates associated with high speed spinning have until now precluded the use of cat-dye polymers for apparel end-use. This has remained the case, even though such yarns, especially when used in combination with conventional-dye nylon, are clearly highly desirable, and offer a great variety of effects in fabric form. A particularly desirable product is a cat-dye nylon partially oriented yarn (POY) which could be used for texturing with a standard-dye yarn to give a textured two-tone heather or marl yarn after dyeing.

A more efficient and higher speed means to spin textile yarns dyeable with cationic dyes is desired in the art. Higher speed spinning means and the products of these high speed processes are disclosed herein. By means of the present invention it is possible to spin both POY and high speed fully-drawn polyamide yarns (FDY) of high cationic dye affinity at superior interruption (filament breakage) rates for a commercial melt-spinning process. Furthermore, the means of filament spinning disclosed herein make it possible to spin critical yarns of fine single filament titre and especially those yarns with filaments of non-circular profiled cross-section.

It has been found by the present inventors that it is possible to spin both POY and high-speed fully-drawn (FDY) mixed polyamide yarns of high cationic-dye affinity at interruption rates acceptable for a commercial melt-spinning process, and that furthermore it is even possible to spin mixed critical yarns, such as yarns containing filaments of fine filament titre, and of non-circular, profiled cross-section. This is achieved by spinning the different filaments of the mixture from separate spinning packs in a spinning machine, and interlacing the filaments in the spinning machine by means of an air interlacing jet after the filaments have solidified but before they are wound up.

Accordingly, the present invention provides a method of making a polyamide mixed yarn comprising: simultaneously spinning a first group of filaments of a first polyamide and a second group of filaments of a second polyamide different from the first polyamide; combining the first and second groups of filaments through an air interlacing jet; and winding up the interlaced filaments.

The yarns made by the method of the invention are normally textile yarns that are especially useful for apparel fabric applications. That is to say, yarns having a yarn weight of from about 5 to about 300 dtex, a filament weight of from about 0.5 to about 7 dtex. Preferably, the yarn comprises from about 3 to about 136 filaments.

Preferably, the yarns have a filament uniformity in Uster % of about 1.5% or less, more preferably about 1% or less. This is desirable in order for the yarn to have the high appearance uniformity needed for apparel applications, and also to reduce yarn breaks in texturing, weaving and knitting operations.

Preferably, the yarns have an elongation to break of from about 20 to about 90%. Preferably, the yarns have a tenacity of from about 25 to about 65 cN/tex. These tensile properties are all desirable for apparel textile applications.

In certain embodiments, the first polyamide has a titanium dioxide content less than 0.1% and preferably less than 0.01% by weight and the second polyamide has a titanium dioxide content greater than 0.3% and preferably greater than 1.0% by weight. This gives a mixed yarn containing bright filament highlights from the clear or bright first component enhanced against the matt or dull second component.

In certain embodiments the first polyamide and the second polyamide have different dyeing characteristics with anionic dyes or cationic dyes. These dyeing characteristics may arise from different numbers of amine end groups. For example, the first polyamide and the second polyamide may differ by at least 8 mols per $10^6$ g in the concentration of amine end groups (AEG), more preferably at least 12 mols per $10^6$ g and more preferably at least 15 mols per $10^6$ g. The AEG number influences how deeply the polyamide is dyed by anionic dyes. Alternatively or additionally, one of the polyamides may contain anionic end groups, such as sulfonate or carboxylate end groups, that render the polyamide cationic-dyeable.

In certain embodiments the first polyamide comprises a cationic-dye polyamide and the second polyamide comprises an anionic-dye polyamide. Preferably, the cationic-dye polyamide has at least 50 anionic end groups per $10^6$ g (AEG). The method according to the invention thereby makes possible for the first time the high speed spinning of apparel yarns that can achieve heather or marl dyeing effects.

In certain embodiments the filaments of the first polyamide and the filaments of the second polyamide in the product yarn exhibit an absolute difference of at least 10% in their boiling water shrinkage values as hereinafter defined. This gives the effect that, in subsequent heat treatment, the high shrink filaments contract, and the lower shrink filaments then stand out to give a bulked or texturised appearance and hand to the yarn or fabric.

For example, the amine component of the first polyamide comprises hexamethylene diamine and the second polyamide is a copolymer in which the amine component comprises a mixture of hexamethylene diamine with at least 20% by weight of methyl pentamethylene diamine based on the total weight of diamine. Preferably, the diamine components of the first and second polyamides are substantially or essentially made up of hexamethylene diamine and hexamethylene diamine/20% methyl pentamethylene diamine. In other embodiments, one of the polyamides may comprise nylon 6 and the other polyamide may comprise nylon 66.

In certain embodiments, one of the said groups of filaments has a circular filament cross-section and the other of the said groups of filaments has a non-circular filament cross-section. This enables further interesting visual effects to be achieved in the same high speed spinning process.

Preferably, the non circular filaments have an individual filament decitex of greater than 2.5 and the circular filaments have individual decitex less than 2.

In certain preferred embodiments the non-circular filaments are trilobal with modification ratio greater than 1.2 and less than 2.4, preferably from about 1.4 to about 1.8. The modification ratio is defined as the ratio of the radius of the smallest circle that circumscribes the profile to the radius of the largest circle that is completely inscribed in the profile.

In other embodiments, the filament cross-section is elongated. Preferably, the cross-section has a two-fold axis of rotational symmetry. For example, the filament cross-section may be selected from the group consisting of oval, tape or diabolo shapes. Preferably, the length ratio (Aspect Ratio) of the longest axis of the elongated filament cross-section to the shortest axis at right angles to that longest axis is greater than about 1.5.

In preferred embodiments, the first group of filaments is bright and trilobal with filament decitex greater than 2.5, modification ratio between 1.4 and 1.8 and made with basic dye polymer and the second group of filaments is dull and circular with filament decitex less than 2 and made with acid dye polymer.

The first and second pluralities of filaments are spun in substantially conventional fashion through laterally spaced first and second pluralities of spinneret holes that are fed with the molten first and second polyamides, respectively. The dimensions of the spinneret holes, melt velocity, temperature, wind-up speed and other spinning conditions are selected in conventional fashion to produce the desired filament properties such as shape, weight, uniformity, and tenacity. The fact that the pluralities of filaments are interlaced introduces the limitation that the wind-up speed is by definition the same for the two pluralities of filaments.

Interlacing, also known as intermingling or entangling, is the process whereby the substantially parallel filaments of a freshly spun multifilament yarn are given coherence by inducing periodically spaced knots or nodes separated by portions of lesser filament entanglement. This periodic node structure is produced by passing the filaments through a fluid jet, the fluid typically being compressed air. The interlace introduces coherence among the filaments of the yarn.

Apparatus for interlacing multifilament yarns includes the Model FG3 from Fibreguide Ltd., Cheshire, U.K., and the Heberlein Polyjet SP from Heberlein Maschinenfabrik AG, Wattwil, Switzerland. The Heberlein Polyjet-SP-25 model H133/C14 was used in the following examples. Typically the air pressure supplied to the air jet interlace apparatus is from 55 to 200 kPa (8 to 30 psi). The level of interlacing generally increases with increase in air pressure and reduction in yarn tension.

The pluralities of filaments may be intermingled individually to provide stronger linking of the filaments of each component before intermingling together. This provides a strong marl with a streaky appearance in the final fabric. Omission of this step causes the filaments to mix intimately when combined to give a shorter term heathe appearance in fabric. The appropriate level of component and combinatio intermingling can readily be determined experimentally for the particular proces conditions to give the appearance desired.

The yarns made in accordance with the present invention preferably have from 6 to 40 interlace nodes per meter.

The methods according to the present invention may further comprise the step of texturing the mixed polyamide yarn by false twist texturing or air-jet texturing.

Preferably, the yarn is wound up at a speed of at least 3000 m/min, more preferably at least 3500 m/min and most preferably at a speed of at least 4000 m/min. This high speed spinning, which has not hitherto been practised with cationic-dye polyamides, provides high yarn output and also provides a degree of orientation of the filaments.

In some embodiments, the yarn is wound up at high speed substantially without an intermediate drawing step, whereby the yarn is a partially oriented yarn (POY).

In other embodiments, the yarn is wound up at high speed with an intermediate drawing step. Preferably this results in a fully drawn yarn (FDY).

In a second aspect, the present invention provides a mixed polyamide yarn obtainable by a method according to the present invention and comprising a first group of filaments of a first polyamide interlaced with a second group of filaments of a second polyamide different from the first polyamide.

Preferably, the yarn according to the present invention is a flat yarn, but it may alternatively be a textured yarn, or a flat yarn combining filaments of different shrinkages to produce a textured appearance and handle when subjected to subsequent dyeing and finishing operations.

In a third aspect, the present invention provides a textile fabric comprising a yarn according to the invention. For example the textile fabric may be a woven, nonwoven or knitted textile fabric, preferably an apparel fabric.

In certain embodiments the fabric according to the present invention comprises cationic-dye polyamide and has been dyed with a cationic dyestuff. Where the fabric comprises a yarn that is a mixture of cationic-dye and anionic-dye filaments, the present invention preferably provides fabrics that have been dyed with both cationic and anionic dyes, preferably in the same dyeing bath. Such fabrics exhibit especially interesting colour effects.

In a fourth aspect the present invention provides a garment comprising a fabric according to the present invention in a visible portion thereof.

Specific embodiments of the present invention will now be described further by way of example, with reference to the accompanying drawing, in which:

FIG. 1 is a schematic of a preferred process for the high speed spinning of the cationic dyeable polyamide yarns in accordance with the present invention.

Here and elsewhere in the present specification the parameters of the process and the yarns are measured as follows.

Yarn & polymer relative viscosities were measured at 25 degrees C. using 8.4% w/w solution of the yarn in formic acid containing 10% water (ASTM D789). The instrument used was an automated capillary viscometer of the timed-flow, U-tube type.

Yarn Decitex (the linear density) was measured at 20 degrees C. and 65% relative humidity using a wrap-wheel & weighing balance, according to the BISFA "Internationally agreed methods for testing polyamide filament yarns"-1995.

Yarn linear density evenness, also known as the yarn Uster percent (U %), was determined using a Uster evenness tester 3, type C.

The oil on yarn percentage was determined using a Bruker NMR (Nuclear Magnetic Resonance) minispec pc-120 instrument. Calibration was made against known standards where oil level had been measured by extracting oil from the yarn by hot petroleum ether, evaporating, and weighing the residue.

Yarn tensile properties (breaking force, tenacity, percentage extension to break and the derived parameter T*RE where T is the tenacity which is multiplied by RE, the square root of the extension to break) were measured on an Instron Tensile Tester model 4301 using conditions stated in the BISFA "Internationally agreed methods for testing polyamide filament yarns"-1995.

Interlace is measured according to ASTM standard method D4724-87 (reapproved 1992). This method covers common procedures for interlace measurement by needle insertion. The results are reported as interlace nodes per meter of interlaced yarn. A suitable apparatus to measure interlace nodes is the Rothschild R2071/72 automated interlace tester from Rothschild Measurement Instruments, Traubenstrasse 3, Zurich, Switzerland.

Boiling water shrinkage was measured according to BISFA "Internationally agreed methods for testing polyamide filament yarns"-1995

Referring to FIG. 1, at 10 or 10' first and second molten polymers are introduced to polymer filter spin packs (12,12') and metered through spinneret plates (14,14') to form two spatially separated pluralities of filaments (18,18') having different filament cross sections. The filaments are quenched via a side stream of conditioned air in quench chimneys (16,16'). Preferably the emerging filaments are cooled in two separate chimneys, so that quench flow rate and other parameters (convergence distance etc.) can be optimised for each component separately. The quenched filaments are converged, preferably separately, into a yarn at a convergence guide (20,20') and oiled at a roll (22,22') to form a spin finished prepared yarn (24,24') which is interlaced at 25 by air jet interlace means.

The interlaced yarn may take Path A to ultimately form an FDY or take Path B to form a POY. Following along Path A, the yarn is withdrawn from the quench chimney by feed roll assembly 26, shown diagrammatically as a single roll, and drawn by roll assembly 28, also shown diagrammatically as a single roll, which has a surface speed greater than roll assembly 26. The drawn yarn is relaxed with atmospheric steam at 32 and optionally intermingled by means of 34 and wound up into a package of fully drawn yarn 36. Following along Path B, the yarn is withdrawn from the quench chimney 16' by feed and yarn tension management roll assembly 26' and 28'. The "S-wrap" configuration provides for good yarn tension management during the winding phase and the intermingler stage 34' is optionally applied before winding up a package of POY 36'.

In the POY spinning process the Godet rolls to control tension are optional. An component intermingling step may be before the first roll followed by the combination intermingler before, between or after the rolls in a POY process.

In the FDY process the air interlace jet may be provided before the draw rolls, or after the relax device, or at any other stage before winding. (Interlacing between the feed and draw rolls is not preferred, because of the high tensions associated with drawing the yarn.)

EXAMPLE 1

The following group of experiments illustrates the possibility of producing a combined or hetero-yarn, by an economical POY or FDY route, on a single spinning machine, without recourse to separate winding and recombination of the cat-dye and anionic-dye component yarns.

In general, two separate polymers, one of standard (anionic) dye polyamide, and the other of cationic-dye polyamide, were independently melted, and separately forwarded via independant metering pumps to two adjacent packs on the spinning machine. The spinnerets of the two packs were variously of the same design, or of different design to allow combinations of different filament cross sections to add a further dimension to the differentiated appearance of the yarn. The emerging molten filaments were cooled by a stream of quench air, converged and oiled on spin finish applicators, and combined through an air interlacing jet.

In the case of POY yarns the combined hetero-yarn was then led as a simple S-wrap over a pair of Godet rolls, and finally wound up as a bobbin on a high speed winder. The use of the Godet rolls is advantageous in order to control the yarn tension and package build, but not essential.

In the case of drawn yarns, the combined hetero-yarn was forwarded to make several turns round a set of Godet rolls (feed rolls), the number of turns being sufficient to prevent slippage over these rolls, then passed over another set of rolls (draw rolls) revolving at sufficient speed to stretch the yarn by a predetermined amount (the draw ratio), and finally heat set with a steam-box. The yarn was finally wound up at a speed in excess of 3000 meters per minute. Optionally, an alternative setting method could have been used, such as heated rolls, and an additional set of Godet rolls may be incorporated between draw rolls and winder to control the tension while the yarn is set or relaxed. Optionally also a second application of spin finish, and/or additional interlacing may be applied before the final winding step.

The cationic-dye polyamides contain a sulphonic acid functional group, introduced by the incorporation of the sodium salt of 5-sulpho-isophthalic acid (molecular weight 268). The specific polymers used had the properties listed in Table 1. Details of the additional, anionic-dyeable polymers used for these hetero-yarns are given in Table 1, and specific yarn examples and spinning details in Table 2.

It can be seen from Table 2 that a wide variety of hetero-yarns is exemplified. These include combinations of:

Cationic and anionic dyeable yarns (all the above);

cationic and deep-dye anionic (high AEG) yarns (G, H);

cationic dye and high shrinkage anionic dye yarns (I);

POY yarns (D to H) and FDY (A to C and I); and

Round/round cross-section (A, I), round/diabolo (B,F), round/trilobal (C,D,H).

Though the scale of the trials was too small to give a precise indication of spinning interruption rate, there were no indications of serious spinning difficulties. Extrusion was clean, and the spinneret face showed no more contamination than is usual with standard high speed processes. Yarn uniformity levels were good, with Uster % values of about 0.8%, and the bobbins of yarn were free from gross loops.

The yarns spun from anionic dyeable/cationic dyeable filament combinations were knitted into hoselegs, and each hoseleg was dyed in a single dye-bath operation using a suitable combination of anionic dye and cationic dye together in the same bath. The dyeing was typically carried out at 100 degrees C. for 1 hour at pH 5.0 in the presence of an anti-precipitating agent to prevent interaction between the two dyes.

The dyed hoselegs had a most attractive heather or marl appearance, each yarn taking up the appropriate dyestuff. By selecting particular dyestuffs, the colour contrast could be varied from subtle to strong, and further variation could be added by combining different yarn cross sections, varying the different filament titres, and adjusting the degree of intermingling.

TABLE 1

| Polymer | RV | AEG | —$SO_3H$ | % $TiO_2$ |
|---|---|---|---|---|
| Cat-1 | 31.5 | 41 | 55 | 0.02 |
| Cat-2 | 45 | 45 | 72 | 0.27 |
| AN-1 | 40 | 50 | 0 | 0.009 |
| AN-2 | 40 | 50 | 0 | 1.0 |
| AN-3 | 40 | 70 | 0 | 1.6 |
| AN-4* | 44 | 45 | 0 | 0.3 |

*Polyamide AN-4 is a copolyamide of adipic acid and hexamethylenediamine with 20% of methylpentamethylenediamine.

TABLE 2

| | Experiment | | | | | | | | |
|---|---|---|---|---|---|---|---|---|---|
| | A | B | C | D | E | F | G | H | I |
| Yarn type | FDY | FDY | FDY | POY | POY | POY | POY | POY | FDY |
| Decitex | 156 | 156 | 156 | 156 | 156 | 156 | 156 | 156 | 156 |
| Filaments | 88 | 46 | 71 | 71 | 71 | 77 | 88 | 71 | 88 |
| Anionic Dye Component | 78f68 | 78f26 | 78f51 | 78f51 | 78f51 | 78f51 | 78f20 | 78f20 | 78f20 |
| Cross section* | R | D | TR | TR | R | R | R | R | R |
| Anionic Dye Polyamide | AN-1 | AN-1 | AN-1 | AN-1 | AN-2 | AN-2 | AN-3 | AN-3 | AN-4 |
| Cationic Dye Component | 78f20 | 78f20 | 78f20 | 78f20 | 78f20 | 78f26 | 78f68 | 78f51 | 78f68 |
| Cross section* | R | R | R | R | TR | D | R | TR | R |
| Cationic Dye Polyamide | CAT-2 | CAT-2 | CAT-2 | CAT-2 | CAT-1 | CAT-1 | CAT-2 | CAT-2 | CAT-1 |
| Extrusion Temperature (C.) | 280 | 279 | 280 | 280 | 278 | 279 | 280 | 280 | 278 |
| Quench air Velocity (m/min) | .35 | .35 | .35 | .35 | .40 | .40 | .35 | .35 | .35 |
| Draw ratio | 1.6 | 1.6 | 1.6 | 1 | 1 | 1 | 1 | 1 | 1.6 |
| Wind speed (m/min) | 4200 | 4200 | 4200 | 4200 | 4200 | 4200 | 4200 | 4200 | 4200 |
| Tenacity (cN/tex) | 44 | 43 | 44 | 32 | 34 | 33 | 32 | 30 | 39 |
| Extensibility % | 49 | 48 | 47 | 74 | 66 | 68 | 73 | 72 | 53 |

*Cross sections: R = round or circular; TR = trilobal; D = diabolo or bilobal.

More subtle colour or shade variants were produced by combining yarns with the same type of dye affinity, but differing in cross-section, content of titanium dioxide delustrant, depth of dyeing characteristic from differing concentrations of amine end groups, or using other polymer variants such as a nylon 6 yarn combined with nylon 66.

Yarn I in Table 2 exemplifies yarns according to the invention containing both high and low shrinkage polyamide components. The yarn was knitted into a hoseleg and dyed in an anionic dyestuff. The fabric after dyeing had a bulked-up textured appearance and feel resulting from the differential shrinkage of the yarns The above embodiments have been described by way of example only. Many other embodiments of the invention falling within the scope of the accompanying claims will be apparent to the skilled reader.

The invention claimed is:

1. A method of making a polyamide mixed yarn comprising: simultaneously spinning from separate spinning packs, a first group of filaments of a first polyamide and a second group of filaments of a second polyamide different from the first polyamide, wherein the first polyamide is a cationic-dye polyamide and the second polyamide is an anionic-dye polyamide; combining the first and second groups of filaments through an air interlacing jet; and winding up the interlaced filaments; wherein said yarn has yarn weight from about 5 to about 300 dtex.

2. The method according to claim 1, wherein the first polyamide has a titanium dioxide content less than 0.1% by weight and the second polyamide has a titanium dioxide content greater than 0.3% by weight.

3. The method according to claim 2, wherein the first polyamide has a titanium dioxide content less than 0.01% by weight and the second polyamide has a titanium dioxide content greater than 1.0% by weight.

4. The method according to claim 2, wherein the first polyamide and the second polyamide have different dyeing characteristics with anionic dyes or cationic dyes.

5. The method according to claim 4, wherein the first polyamide and the second polyamide differ by at least 8 mols per $10^6$ g in the concentration of amine end groups (AEG).

6. The method according to claim 2, wherein the filaments of the first polyamide and the filaments of the second polyamide in the product yarn exhibit a difference of at least 10% in their boiling water shrinkage values.

7. The method according to claim 2, wherein the amine component of the first polyamide comprises hexamethylene diamine and the second polyamide is a copolymer in which the amine component consists comprises a mixture of hexamethylene diamine with at least 20% by weight of methyl pentamethylene diamine based on the total weight of diamine.

8. The method according to claim 2, wherein one of the said groups of filaments is has a circular filament cross-section and the other of the said groups of filaments has a non-circular filament cross-section.

9. The method according to claim 8, wherein the filaments with noncircular filament cross-section have an individual filament decitex of greater than 2.5 and the filaments with the circular filament cross-section have individual decitex less than 2.

10. The method according to claim 9, wherein the filaments with the non-circular filament cross-section are trilobal with modification ratio greater than 1.2 and less than 2.4.

11. The method according to claim 2, wherein the first group of filaments is brighter than the second group of filaments, and the first group of filaments has filaments with trilobal cross-section and with individual filament decitex greater than 2.5, has modification ratio between 1.4 and 1.7, and the second group of filaments has filaments with circular cross-section and with individual filament decitex less than 2.

12. The method according to claim 1, further comprising the step of texturing the mixed polyamide yarn by false twist texturing or airjet texturing.

13. The method according to claim 1, wherein the yarn has a tenacity of from about 25 to about 65 cN/tex and an elongation to break of from about 20 to about 90%.

14. A method of making a polyamide mixed yarn comprising: simultaneously spinning from separate spinning packs, a first group of filaments of a first polyamide and a second group of filaments of a second polyamide different from the first polyamide; combining the first and second groups of filaments through an air interlacing jet; and winding up the interlaced filaments at a speed of at least 3000 m/min, wherein the first polyamide is a cationic-dye polyamide and the second polyamide is an anionic-dye polyamide; and said yarn has yarn weight from about 5 to about 300 dtex.

* * * * *